US006367948B2

(12) United States Patent
Branson

(10) Patent No.: US 6,367,948 B2
(45) Date of Patent: Apr. 9, 2002

(54) ILLUMINATED BASKETBALL BACKBOARD

(76) Inventor: William A. Branson, 8274 Lytel Trails Rd., Waynesville, OH (US) 45068

( * ) Notice: Subject to any disclaimer, the term of this patent is extended or adjusted under 35 U.S.C. 154(b) by 0 days.

(21) Appl. No.: 09/766,286

(22) Filed: Jan. 19, 2001

Related U.S. Application Data

(60) Provisional application No. 60/204,265, filed on May 15, 2000.

(51) Int. Cl.[7] ..... A63B 63/08

(52) U.S. Cl. ..... 362/234; 362/253; 362/369; 473/479

(58) Field of Search ..... 362/234, 240, 362/253, 369; 473/479, 481, 480, 485

(56) References Cited

U.S. PATENT DOCUMENTS 4,858,920 A * 8/1989 Best ..... 473/480
5,305,998 A * 4/1994 Nesbit et al. ..... 362/253
5,346,207 A * 9/1994 Heinen ..... 473/481
5,711,727 A * 1/1998 Edge et al. ..... 473/479

* cited by examiner

*Primary Examiner*—Stephen Husar
(74) *Attorney, Agent, or Firm*—Biebel & French

(57) ABSTRACT

A self contained lighting apparatus releasably supported by a conventional translucent basketball backboard. The lighting apparatus includes a translucent front panel and a back panel defining an interior chamber. A reflective surface is disposed within the interior chamber and a plurality of substantially uniformly distributed light sources are supported proximate the reflective surface. The light generated from a plurality of light sources reflects off the reflective surface and is directed toward the front panel. The front panel preferably diffuses the light which then passes to the translucent backboard panel for providing a substantially uniform illumination of the backboard and adjacent rim.

25 Claims, 8 Drawing Sheets

ILLUMINATED BASKETBALL BACKBOARD

CROSS-REFERENCE TO RELATED APPLICATION

This application claims the benefit of U.S. Provisional Patent Application Ser. No. 60/204,265, filed May 15, 2000.

BACKGROUND OF THE INVENTION

1. Field of the Invention

The present invention relates to basketball goals and, more particularly, to a lighting apparatus for illuminating a basketball backboard and rim.

2. Description of the Prior Art

The game of basketball is a well-known and popular sport. A traditional basketball goal includes a vertically disposed backboard and a rim extending substantially perpendicular thereto in a horizontal plane and into which a basketball is thrown. The goal is usually supported a predetermined distance above the ground by a backstop attached to a pole. Alternatively, the goal may be supported by another structure, such as a backstop attached to a building.

Given the popularity of basketball, many individuals play the game at night, both indoors and outdoors, relying upon the light of street lamps or building lamps. However, such light typically fails to provide sufficient illumination of the goal. For example, conventional lamps often have an insufficient height for illuminating the goal. Additionally, such lamps are typically not bright enough to transmit sufficient light to the basketball goal or are unattractive for players due to the blinding contrast of intense backlighting coupled with annoying shadows. In addition, many neighbors in residential environments commonly complain about flood lights which they likewise find to be offensive.

In response to the inadequacies of traditional outdoor lighting systems, several attempts have been made to illuminate the basketball goal and surrounding area. For example, U.S. Pat. No. 4,984,787 to Nesbit et al. discloses an illumination means secured to a basketball backboard. Additionally, U.S. Pat. No. 5,711,727 to Edge et al. discloses a light source which is removably secured about the perimeter of a basketball backboard. However, the prior art has failed to provide a lighting apparatus which is self contained and removably secured to a basketball backboard and which also supplies a uniform distribution of light for illuminating the entire front surface of the backboard and the adjacent rim. Indeed, the challenge of providing a more direct light source, protecting that light source from damage, and filtering that light source while at the same time providing enough light to illuminate the court area around the backboard have not been addressed by the prior art.

SUMMARY OF THE INVENTION

The present invention provides a self contained lighting apparatus removably supported by a basketball backboard for supplying substantially uniform illumination to the entire front surface of the backboard, the adjacent rim and the surrounding area.

The lighting apparatus is removably secured to a traditional basketball goal including a backboard having a frame supporting a translucent, typically transparent, backboard panel. The backboard panel includes substantially planar front and rear surfaces extending in a vertical plane. A rim extends substantially perpendicular to the backboard panel in a horizontal plane. The rim supports a net in a conventional manner. The frame of the backboard is typically secured to a backstop which attaches to a vertically extending pole whereby the basketball goal is supported a predetermined distance above the ground.

The lighting apparatus comprises a housing including a translucent, or transparent, front panel having inner and outer surfaces, wherein the outer surface is positioned proximate the backboard panel. A rear panel including inner and outer surfaces is secured relative to the front panel. An interior light chamber is defined intermediate the inner surfaces of the front and rear panels.

A reflective surface is disposed within the interior chamber in substantially parallel relation to the backboard panel. The reflective surface may be supported by a reflective panel including first and second layers defining a perimeter wherein the first layer supports the reflective surface facing the inner surface of the front panel. The reflective panel preferably further includes a cushioning material disposed intermediate the first and second layers to absorb impact from the backboard panel. A plurality of light sources are supported within apertures formed within the reflective panel. The light sources are distributed substantially uniformly within a plane substantially parallel to the reflective surface.

First and second releasable securing devices are provided within the lighting apparatus. The first releasable securing device is positioned intermediate the front panel and the reflective panel, while the second releasable securing device is positioned intermediate the rear panel and the reflective panel. Each of the first and second releasable securing devices includes portions positioned proximate the perimeter of the reflective panel for securing the front and rear panels thereto, respectively.

A translucent buffer member is preferably positioned intermediate the front panel and the reflective panel. The buffer member may comprise a buffer sheet including a plurality of spacer tips for providing an additional impact cushion intermediate the backboard panel and the light sources positioned within the reflective panel. Alternatively, the buffer member may comprise a plurality of buffer pegs supported by the reflective or rear panel.

A third releasable securing device is fixed to the rear panel of the lighting apparatus for releasably supporting the lighting apparatus from the backboard. In the preferred embodiment, the third releasable securing device secures the rear panel to the frame of the backboard.

A back guard may be positioned outwardly from the rear surface of the rear panel and attached to the frame of the basketball goal to protect the lighting apparatus from impact applied to the rear of the backboard.

Therefore, it is an object of the present invention to provide a lighting apparatus which supplies substantially uniform illumination to a basketball goal.

It is a further object of the present invention to provide such a lighting apparatus which may be easily installed and removed from a wide variety of conventional basketball goals.

Another object of the present invention is to provide a structure facilitating routine servicing of the lighting apparatus.

It is another objection of the invention to provide a lighting apparatus to illuminate the court area around the goal thereby eliminating the need for a spotlight to see the ball or other players.

It is a further object of the invention to provide a lighting apparatus permitting installation using standard grounded extension cords.

It is another object of the present invention to provide such a lighting apparatus which is inexpensive and easy to manufacture.

It is a further object of the present invention to provide such a lighting apparatus which includes a reflective panel for directing light toward a front surface of a translucent backboard.

It is yet another object of the present invention to provide such an apparatus which includes a translucent sheet for diffusing light thereby providing a substantially uniform light distribution.

Other objects and advantages of the invention will be apparent from the following description, the accompanying drawings and the appended claims.

DETAILED DESCRIPTION OF THE PREFERRED EMBODIMENT

Figure 1:
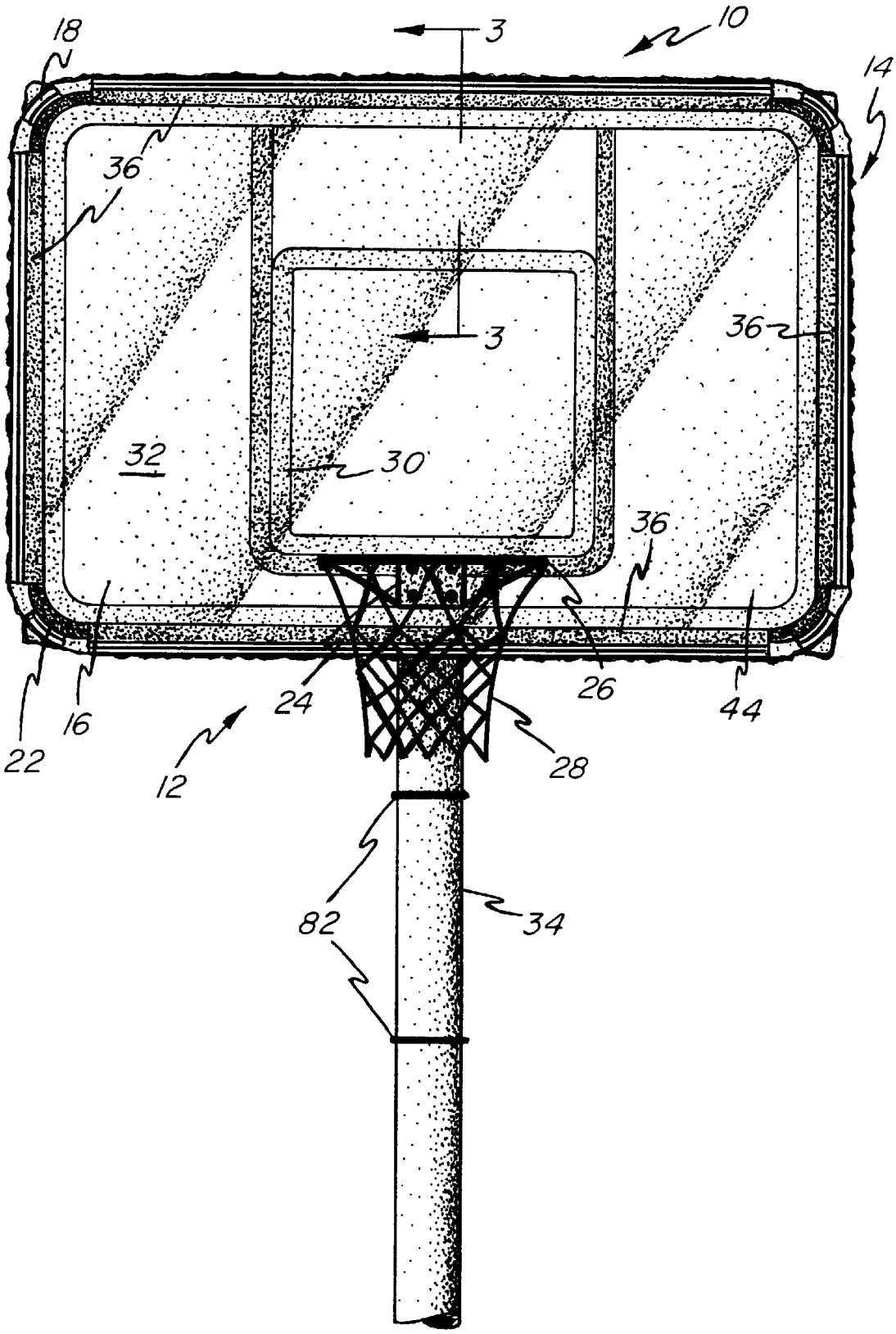
FIG. 1 is a front elevational view of the lighting apparatus of the present invention as attached to a basketball backboard.
Figure 2:
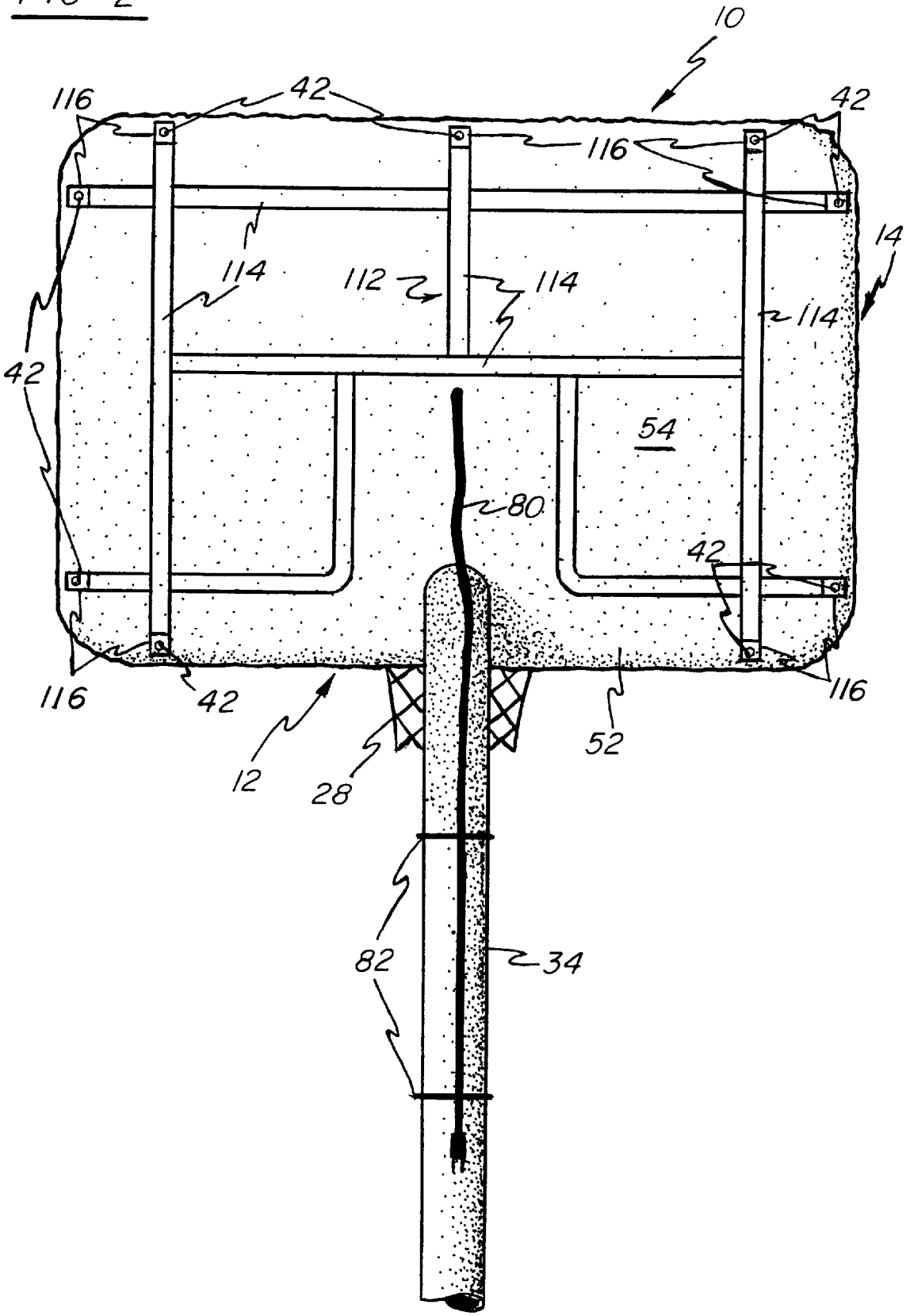
FIG. 2 is a rear elevational view of FIG. 1.

Referring initially to FIGS. 1 and 2, a first embodiment of the lighting apparatus 10 of the present invention is illustrated as releasably secured to a conventional basketball goal 12. While the basketball goal 12 may comprise any of a wide variety of those commercially available, the Clear Slam™ Backboard Model No. 90952-7081, available from Huffy Sports of Sussex, Wis., is used in the following description for illustrative purposes only with respect to FIGS. 1–5.

The basketball goal 12 includes a backboard 14 having a backboard panel 16 supported by a frame 18. The backboard panel 16 is preferably composed of a translucent material, and most preferably a transparent material, typically a composite acrylic, for permitting the transmission of light therethrough. The frame 18 preferably comprises rigid tubular members 20 disposed adjacent the periphery 22 of the backboard panel 16. Additional tubular members 20 may be positioned proximate the center of the backboard panel 16 for additional support. A mounting bracket 24 is disposed proximate a lower center of the backboard panel 16 and is fixed to the frame 18. The mounting bracket 24 supports a conventional annular rim 26 which, in turn, supports a net 28. A target 30 may be positioned adjacent the outer surface of the backboard panel 16. A vertically extending pole 34 supports the backboard 14 a predetermined distance above the ground in a manner known in the art.

Figure 3:
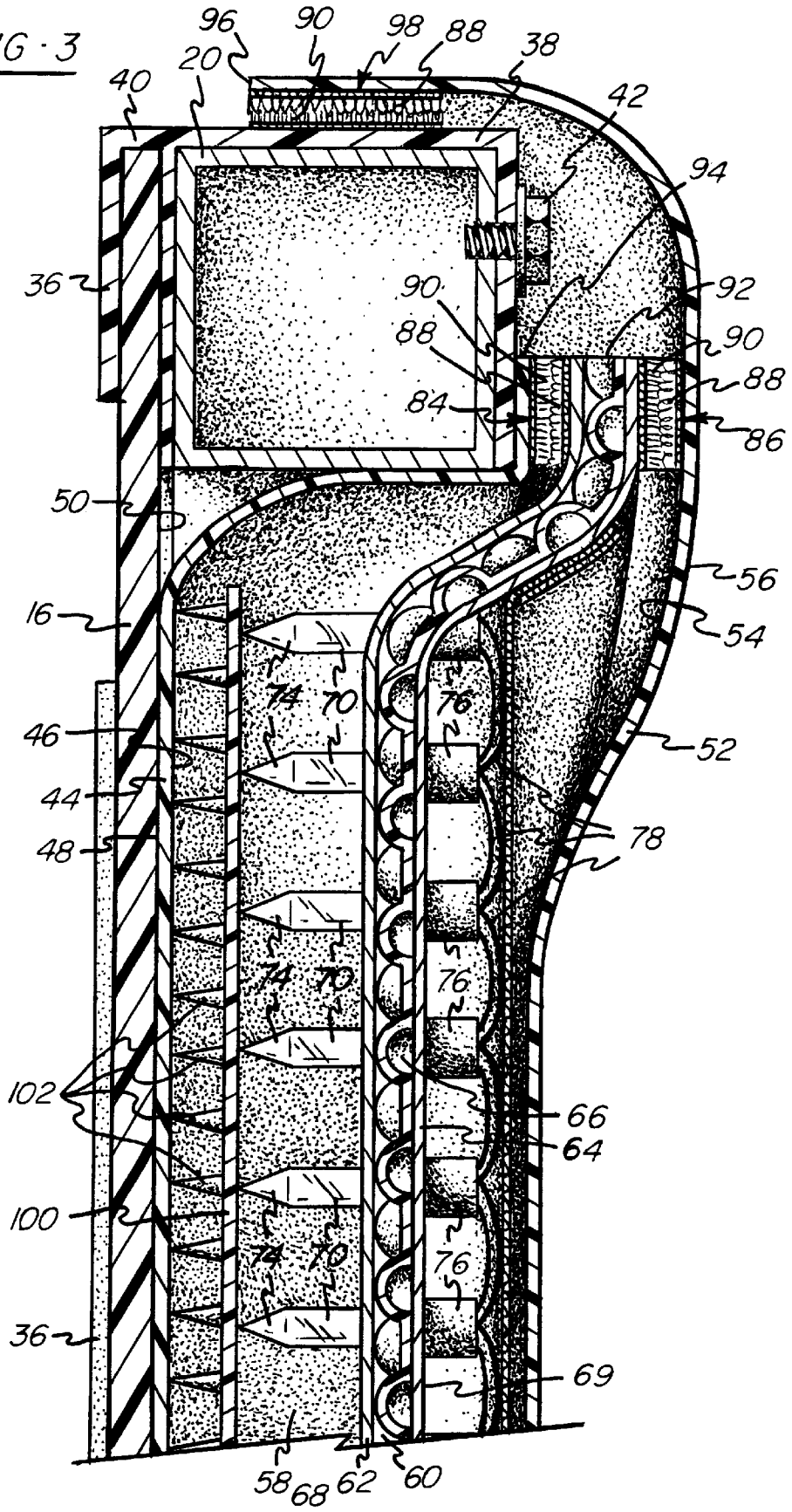
FIG. 3 is a cross-sectional view taken along line 3—3 of FIG. 1, with the back guard removed for clarity.

Referring now to FIGS. 1 and 3, the backboard panel 16 may be secured to the frame 18 through a plurality of clips 36. The clips include a first U-shaped portion 38 which receive a tubular member 20 and a second U-shaped portion 40 which receives the backboard panel 16. The clips 36 are secured to the frame 18 through a plurality of fasteners 42, preferably screws.

The lighting apparatus 10 of the present invention as illustrated in FIGS. 1–5 is in the general form of a light bag. More particularly, the lighting apparatus 10 comprises housing including a front panel 44 having inner and outer surfaces 46 and 48. The outer surface 48 of the front panel 44 is positioned in proximity to a substantially planar inner surface 50 of the backboard panel 16. The front panel 44 is preferably formed from a resilient translucent material, such as a polyvinyl film, for permitting the transmission of light therethrough. However, the front panel 44 may alternatively be formed of a rigid translucent material, such as plexiglass. It should further be appreciated that the front panel 44 is preferably translucent, but not transparent, for diffusing light if the backboard panel 16 is transparent, thereby providing for a substantially uniform appearance of the transmitted light as detailed below. However, if the backboard panel 16 is translucent, but not transparent, then the front sheet 44 may not only be translucent but transparent as well.

A rear panel 52 having inner and outer surfaces 54 and 56 is secured relative to the front panel 44. The rear panel 52 is preferably opaque for preventing the transmission of light therethrough, and may comprise a composite such as a polyvinyl. It should be noted that the rear panel 52 may include translucent or transparent windows (not shown) for permitting selective illumination of components (such as the pole 34) behind the lighting apparatus 10. As with the front panel 44, the real panel 52 may be formed of a rigid material, such as plexiglass or rigid molded vinyl. The front and rear panels 44 and 52 define an interior chamber 58 intermediate the inner surfaces 46 and 54. Apertures (not shown) may be provided within the front or rear panels 44 or 52 to facilitate dissipation of heat and drainage of water from the chamber 58.

A reflective panel 60 is disposed within the interior light chamber 58 and preferably includes first and second layers 62 and 64 and a cushioning material disposed intermediate the first and second layer 62 and 64. The first layer 62 includes a reflective surface 68 facing the inner surface 46 of the front panel 44. The cushioning material 66 preferably comprises a plurality of air pockets for absorbing impact applied to the backboard 14. However, it may be appreciated that other cushioning materials 66, including foam or corrugations, may be readily substituted therefor.

A plurality of light sources 70 are supported within apertures 72 formed within the reflective panel 60. The light sources 70 preferably comprise conventional lamps each having a bulb or an illuminating portion 74 proximate the reflective surface 68 whereby light supplied therefrom is directed toward the backboard panel 16. A base 76 of each of the light sources 70 is disposed adjacent the second layer 64 of the reflective panel 60. The light sources 70 are interconnected by wiring 78 which leads to a common electrical supply cord 80 extending outwardly from the rear panel 52 (FIG. 2). The cord 80 may be secured to the pole 34 through conventional fasteners, such as hook and loop fastening straps 82 or ties.

Figure 4:
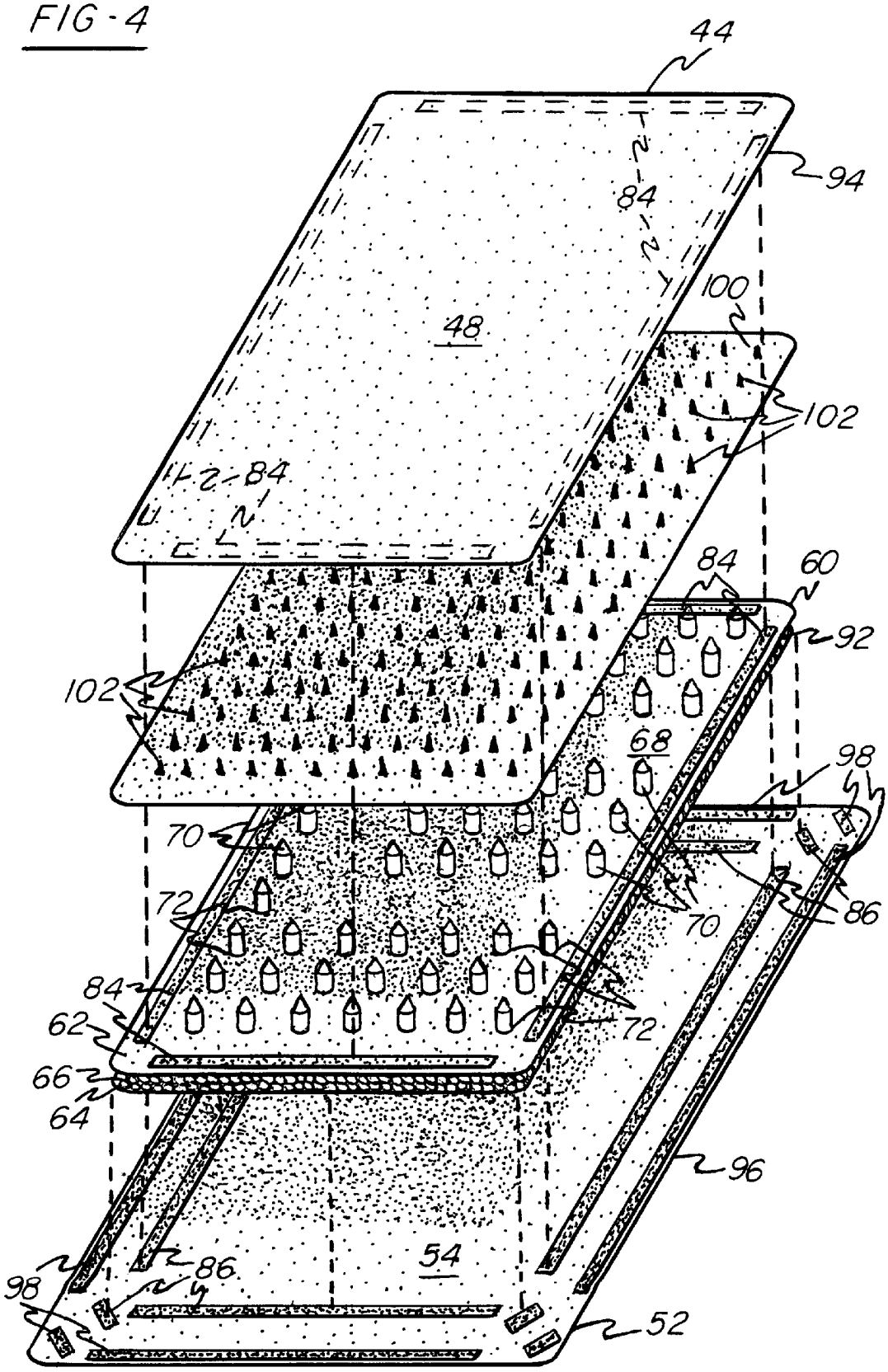
FIG. 4 is an exploded perspective view, in partial schematic, of the lighting apparatus of the present invention.

Turning now to FIGS. 3 and 4, the light sources 70 are disposed in a substantially uniform manner within a plane extending substantially parallel to the reflective panel 60. As such, the light sources 70 provide a substantially uniform distribution of light which is directed by the reflective panel 60 toward the front panel 44. The front panel 44, in turn, preferably diffuses the light directed from the reflective panel 60 to further assist in providing a substantially uniform distribution of light transmitted through the backboard panel 16. As noted above, if the backboard panel 16 is translucent but not transparent, the front panel 44 may be transparent whereby the backboard panel 16 itself diffuses the light from the light sources 70.

Referring further to FIGS. 3 and 4, a first releasable securing device 84 is positioned intermediate the front panel 44 and the reflective panel 60, while a second releasable securing device 86 is positioned intermediate the reflective panel 60 and the rear panel 52. More particularly, the first and second securing devices 84 and 86 releasably secure the reflective panel 60 to the front panel 44 and the rear panel 52 respectively. Each of the first and second securing devices 84 and 86 preferably comprises a hook and loop fastener, although similar releasable securing devices, such as snaps or clips, may be readily substituted therefor. Referring further to FIGS. 3 and 4, the loop portion 88 of the first securing device 84 is fixed to the reflective surface 68 of the reflective panel 60 adjacent its peripheral edge 92. The hook portion 90 is likewise secured to the inner surface 46 of the front panel 44 adjacent its peripheral edge 94 thereof.

In a similar fashion, the loop portion 88 of the second securing device 86 is fixed to the inner surface 54 of the rear panel 52 in spaced relation to its peripheral edge 96. The hook portion 90 of the second securing device 86 is fixed to the rear surface 69 of the reflective panel 60 adjacent its peripheral edge 92.

A third securing device 98 is disposed intermediate the backboard 14 and the rear panel 52 for releasably securing the lighting apparatus 10 to the backboard 14. Similar to the first and second securing devices 84 and 86, the third securing device 98 preferably comprises a hook and loop fastener including a loop portion 88 and a hook portion 90, but may alternatively comprise other releasable securing devices, such as snaps or clips. The loop portion 88 of the third securing device 98 is preferably disposed intermediate the peripheral edge 96 of the rear panel 52 and the loop portion 88 of the second securing device 86. The hook portion 90 of the third securing device 98 is preferably disposed adjacent the periphery 22 of the backboard panel 16. More particularly, in the preferred embodiment, the hook portion 90 is secured to an outer surface of the clips 36.

As illustrated in FIG. 4, the first, second and third securing devices 84, 86 and 98 all preferably comprise a plurality of strips extending proximate the respective peripheral edges 92, 94 and 96 of the reflective panel 60, front sheet 44 and rear sheet 52.

A translucent buffer member, preferably sheet 100 may be disposed intermediate the light sources 70 and the front panel 44. The buffer sheet 100 preferably includes a plurality of spacer tips 102 for spacing the light sources 70 away from the backboard panel 16. As such, the buffer sheet 100 assists in preventing impact applied against the backboard panel 16 from damaging the light sources 70.

Figure 5:
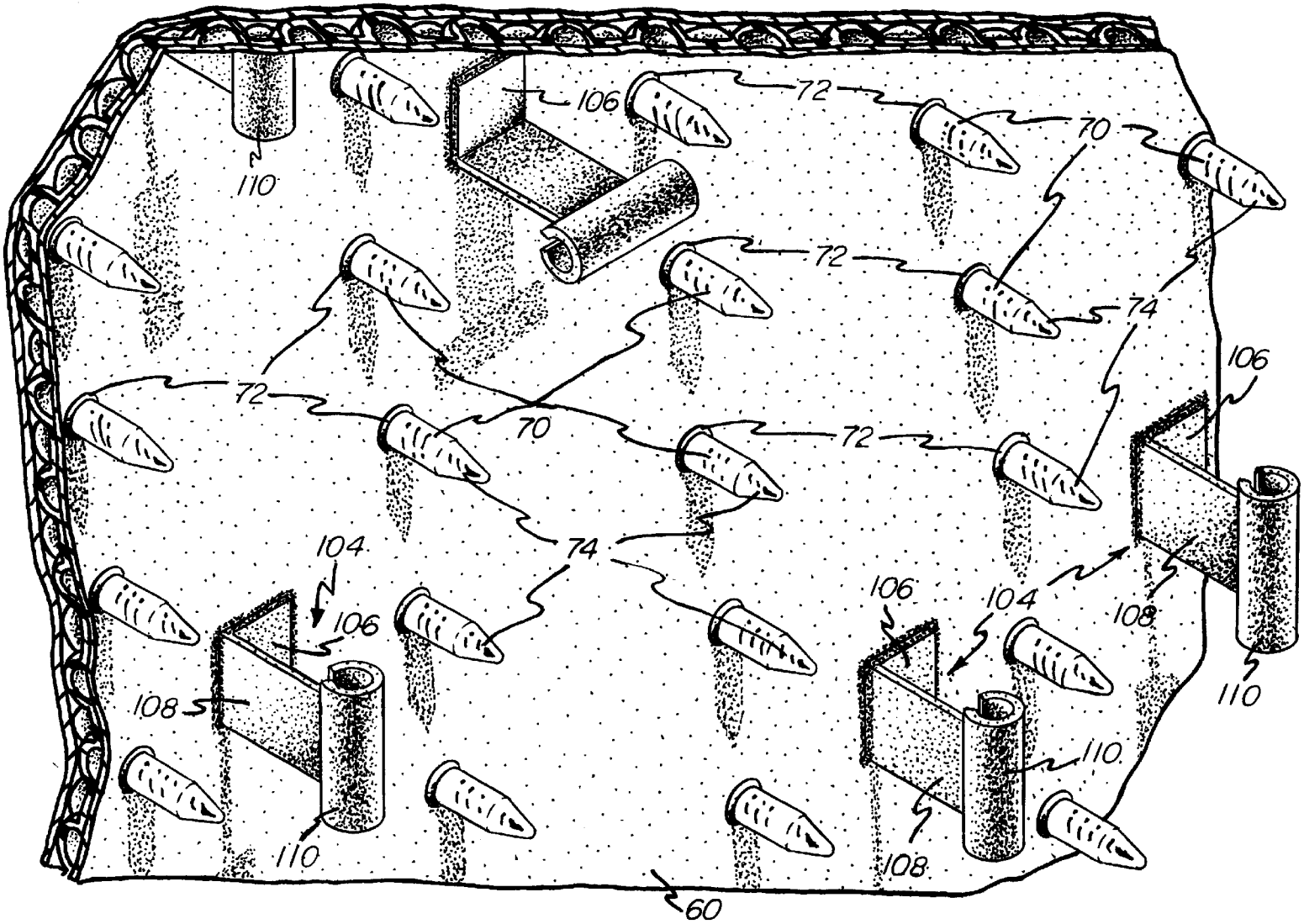
FIG. 5 is a detail perspective view of an alternative bumper member supported by the reflective panel of the present invention.

Turning to FIG. 5, in an alternative embodiment of the lighting apparatus 10, the buffer member comprises a plurality of buffer pegs 104 supported by and extending outwardly from the reflective panel 60. Each buffer peg 104 preferably includes a base 106 secured to the reflective panel 60 and supporting an outwardly extending leg 108. A protective cover 110 is fixed to an end of the leg 108 to provide an acuate surface for contacting the front panel 44 and thereby preventing damage to either the housing or the light sources 70. The buffer pegs 104 are preferably supported throughout the reflective panel 60 and are formed of a translucent material to permit the passage of light therethrough.

In a further alternative embodiment of the lighting apparatus 10, the buffer member 100 may be eliminated by spacing the front panel 44 a predetermined distance away from the backboard panel 16. Moreover, an air gap is provided intermediate the outer surface 48 of the front panel 44 and the inner surface 50 of the backboard panel 16. The air gap prevents impact applied to the backboard panel 16 from being transmitted directly to, and thereby damaging, the front panel 44 and light sources 70.

Referring again to FIG. 2, in the preferred embodiment, the lighting apparatus 10 includes a back guard 112 for protecting against impact applied from the rear of the backboard 14. The back guard 112 preferably includes a plurality of intermeshed wires 114. The back guard 112 is mounted to the frame 18 using the fasteners 42 which pass through mounting tabs 116.

It should be appreciated that the rear panel 52 may be releasably secured to the back guard 112, through the third releasable securing device 98, rather than directly to the backboard 14. As such, the lighting apparatus 10 would be supported by the backboard 14 through the back guard 112 which is secured to the frame 18.

Figure 6:
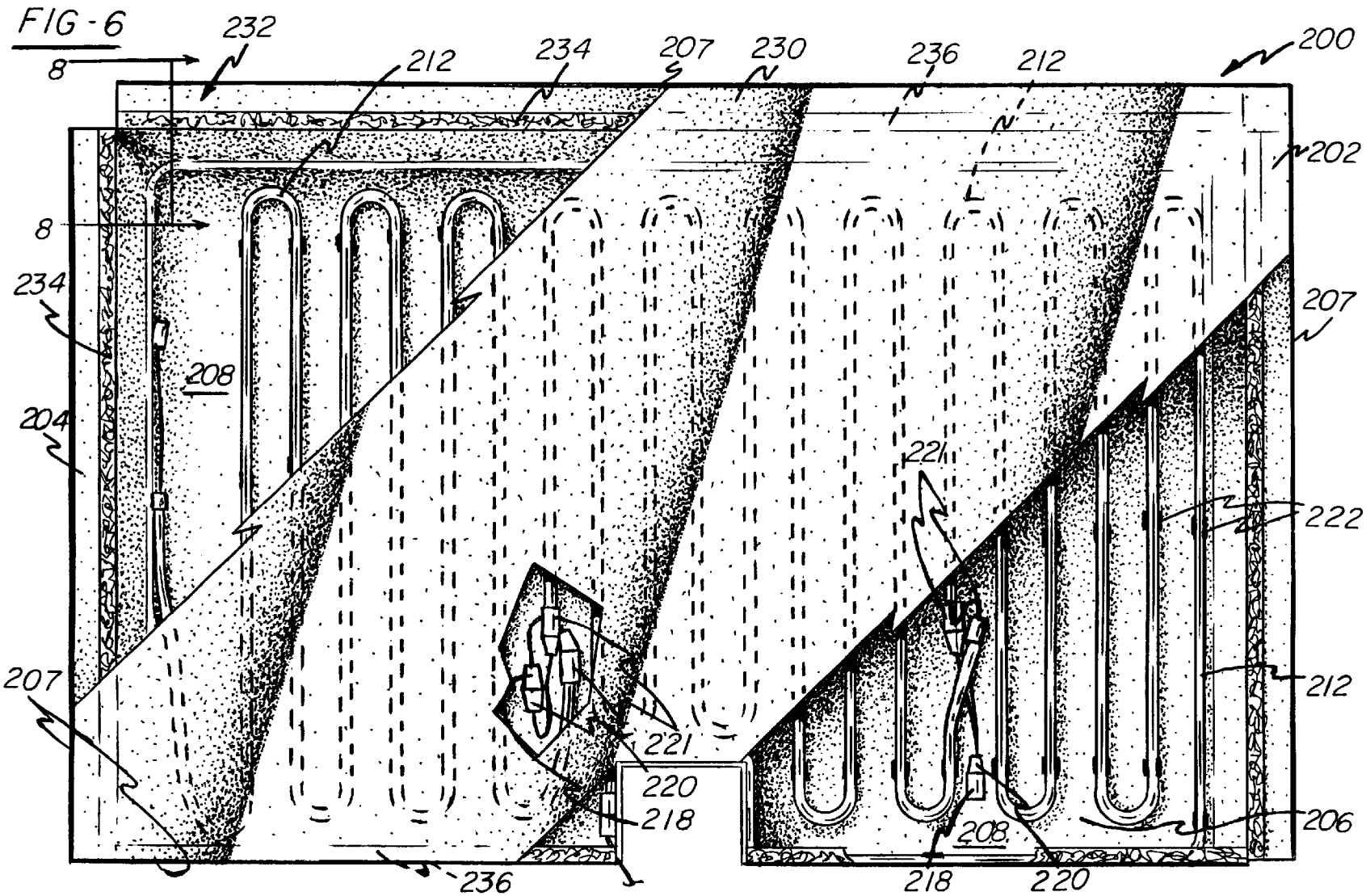
FIG. 6 is a, front elevational view, with a partial cut away, of an alternative embodiment of the lighting apparatus of the present invention.
Figure 7:
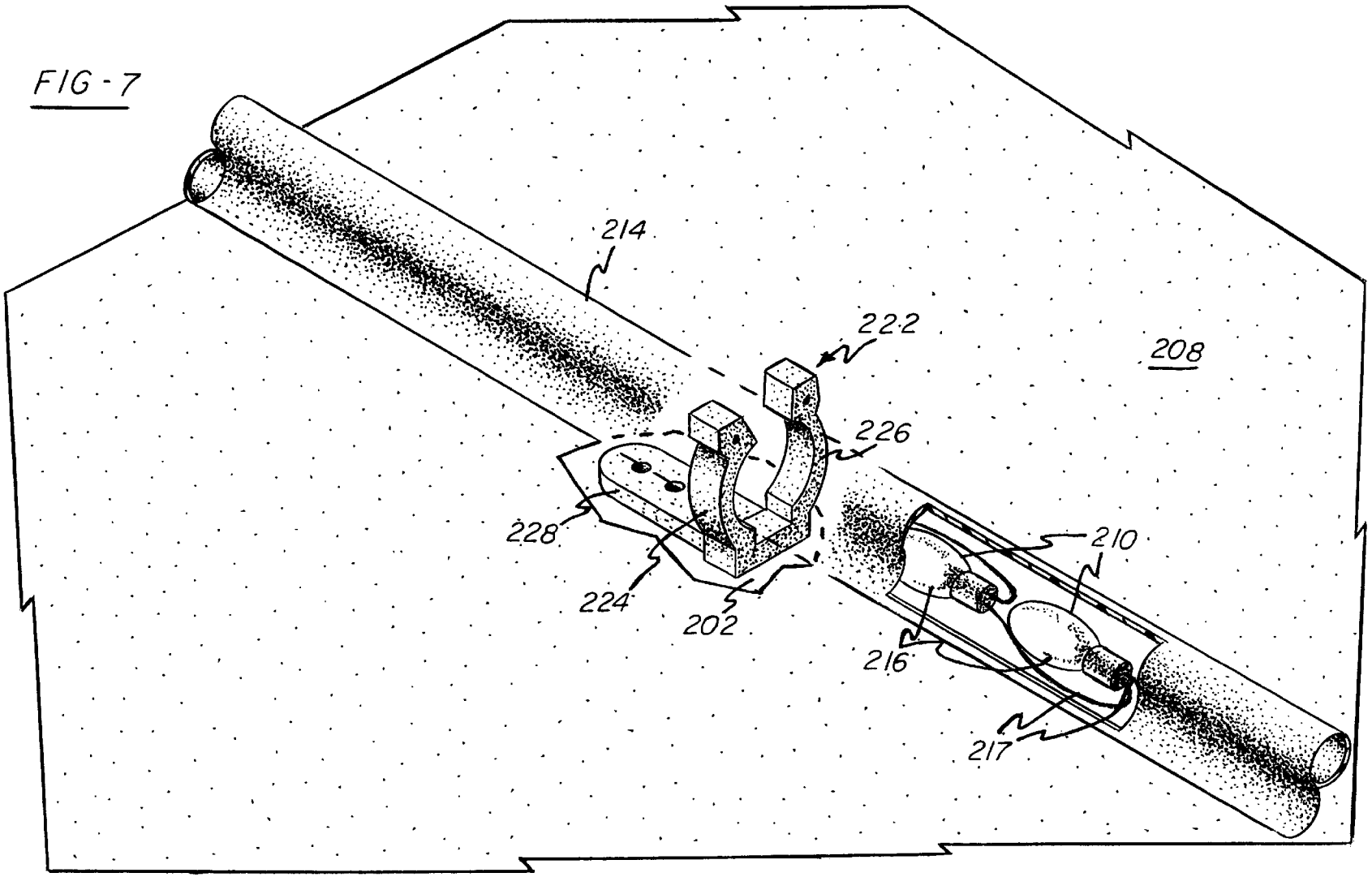
FIG. 7 is a detail perspective view, with a partial cut-away, of FIG. 6.
Figure 8:
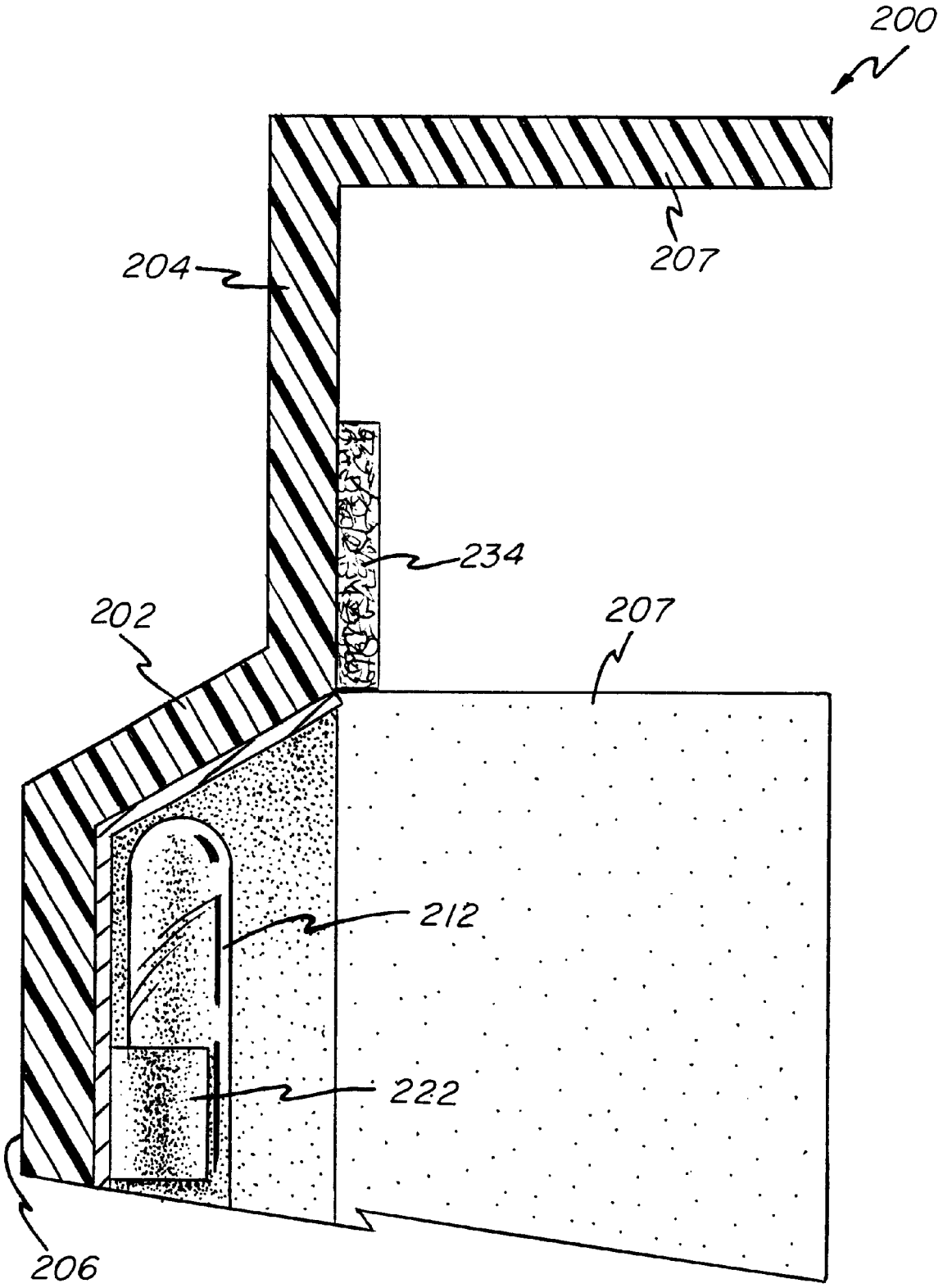
FIG. 8 is a cross-sectional view taken along line 8—8 of FIG. 6.

FIGS. 6 and 7 illustrate an alternative embodiment of the lighting apparatus 200 of the present invention. The lighting apparatus 200 includes a rear panel 202 having a rim 204 extending substantially around the periphery of a center recessed portion 206. A flange 207 may be provided in perpendicular relation to the rim 204 and facilitates placing and securing the rear panel 202 on the backboard frame 18. The rear panel 202 is preferably opaque for preventing the transmission of light therethrough, and can be constructed of various materials but most preferably comprises a composite such as rigid molded vinyl or high density polyethylene. The rear panel 202 may include translucent or transparent windows (not shown) for permitting selective illumination of components (such as the pole 34) behind the lighting apparatus 200.

A reflective surface 208 is preferably supported by the center section 206 of the rear panel 202. While the reflective surface 208 may be formed of the same material as the reflective panel 60 as described above, it should be appreciated that the reflective surface 208 may be alternatively formed integral with the rear panel 202. Moreover, the reflective surface 208 may be a white, or other similarly reflective surface, formed within the rear panel 202.

A plurality of light sources 210 are supported by the rear panel 202. The light sources 210 are preferably contained within a plurality of flexible lighting tubes 212 arranged successively in an end to end relationship along a serpentine path. The flexible lighting tubes 212 each include a hollow flexible tube 214 and a plurality of electrically interconnected lamps 216 disposed within the tube 214 (FIG. 7). The lamps 216 are interconnected through traditional wires 217. In the preferred embodiment, the tubes 214 are formed of a resilient thermoplastic to protect and provide a cushioning effect to the lamps 216. The individual flexible lighting tubes 212 are of conventional design of the type available from Wide Loyal Industries of Hong Kong, China.

The embodiment of the lighting apparatus 200 in FIG. 6 illustrates a plurality of lighting tubes 212, each having a male plug 218 and a female socket 220. The male plug 218 of each lighting tube 212 is received within the female socket 220 of adjacent lighting tube 212 as is known in the art. Each lighting tube 212 may also include a conventional fuse 221. It is preferred to use a plurality of lighting tubes 212 such that if one lighting tube 212 should require replacement, only a portion of the overall lighting assembly requires replacement. However, it may be appreciated that a single lighting tube 212 may extend along the entire serpentine path of the lighting apparatus 200.

A plurality of clips 222 are secured to the rear panel 202 for holding the lighting tubes 212 in place. As illustrated FIG. 7, each clip 222 includes a pair of resilient arms 224 and 226 extending upwardly from a base 228. The base 228 is secured to the rear panel 202 through conventional fastening means, such as adhesives or ties. Alternatively, the base 228 of each clip 222 may be integrally formed with the rear panel 202 or snap fit into slots (not shown) formed in the rear panel 202.

A front translucent panel 230 may be releasably secured to the rear panel 202. The front translucent panel 230 preferably comprises a rigid plexiglass and is secured to the rear panel 202 through a releasable securing means 232. The releasable securing means 232 may comprise a hook and loop fastener including strips of looped portion 234 secured to the rear panel 202 and strips of hook portion 236 secured to the front panel 230. It should be appreciated that a similar securing means, such as snaps, clips or screws, may be readily substituted for the hook and loop fastener. It should be further noted that the front panel 230 may be formed of a transparent material should the basketball backboard panel 16 be formed a translucent material. Likewise, the front panel 230 may be omitted in its entirety should the basketball backboard panel 16 be formed of a translucent material.

The lighting apparatus 200 may be secured to the basketball backboard 14 in a manner similar to that identified above with respect to the first embodiment of the lighting apparatus 10. Further, a resilient seal or gasket (not shown) may be provided adjacent the rim 204 of the rear panel 202 to seal and protect the interior of the lighting apparatus 200.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A lighting apparatus for releasable attachment to a basketball backboard including a backboard panel having a front surface and a rear surface, said lighting apparatus comprising:

a housing including a rear panel having an inner surface and an outer surface, said inner surface of said rear panel adapted to be positioned with said inner surface facing a rear surface of a backboard panel;

a releasable securing device connected to said housing for releasably supporting said rear panel from a backboard;

a reflective surface supported by said housing intermediate said rear panel and the backboard panel; and a plurality of light sources supported proximate said reflective surface and substantially uniformly distributed within a plane substantially parallel to said reflective surface.

2. The lighting apparatus of claim 1 wherein said housing further comprises a translucent front panel positioned intermediate said reflective panel and the backboard panel, said rear panel and said front panel defining a light chamber.

3. The lighting apparatus of claim 1 wherein said reflective surface is defined by said inner surface of said rear panel.

4. The lighting apparatus of claim 1 further comprising a reflective panel positioned in spaced relation to said rear panel, said reflective surface defined by said reflective panel.

5. The lighting apparatus of claim 4 wherein said plurality of light sources comprise a plurality of lamps supported by said reflective panel.

6. The lighting apparatus of claim 5 further comprising a buffer member supported intermediate said reflective panel and the backboard panel for protecting said plurality of lamps from impact.

7. The lighting apparatus of claim 1 wherein said plurality of light sources comprise a plurality of lamps supported by said rear panel.

8. The lighting apparatus of claim 1 wherein said plurality of light sources comprise a plurality of lamps and flexible tubing receiving said plurality of lamps.

9. The lighting apparatus of claim 8 further comprising a plurality of resilient clips securingly engaging said flexible tubing.

10. The lighting apparatus of claim 1 further comprising a back guard extending outwardly from said rear surface of said rear panel and supported by the backboard for protecting said rear panel from impact.

11. A lighting apparatus for releasable attachment to a basketball backboard including a backboard panel having a front surface and a rear surface, said lighting apparatus comprising:

a housing including a translucent front panel and a rear panel releasably secured relative to said front panel;

a reflective panel supported intermediate said front panel and said rear panel, said reflective panel including a reflective surface facing toward said front panel;

a plurality of light sources supported by said reflective panel and substantially uniformly distributed within a plane substantially parallel to said reflective surface; and a releasable securing device connected to said housing for releasably supporting said housing from a backboard.

12. The lighting apparatus of claim 11 further comprising a buffer member positioned intermediate said reflective panel and said front panel.

13. The lighting apparatus of claim 12 wherein said buffer member comprises a plurality of buffer pegs supported by said reflective panel.

14. The lighting apparatus of claim 11 wherein said plurality of light sources comprises a plurality of lamps extending through said reflective panel, each said lamp including a bulb positioned proximate said reflective surface for directing light toward said front panel.

15. A lighting apparatus for releasable attachment to a basketball backboard including a backboard panel having a front surface and a rear surface, said lighting apparatus comprising:

a rear panel having an inner surface and an outer surface, said rear panel adapted to be positioned with said inner surface facing a rear surface of a backboard panel;

a releasable securing device connected to said rear panel for releasably supporting said rear panel from a backboard;

a reflective surface supported intermediate said rear panel and the backboard panel; and a plurality of light sources supported proximate said reflective surface and substantially uniformly distributed within a plane substantially parallel to said reflective surface, said plurality of light sources comprising flexible tubing and a plurality of lamps received within said tubing.

16. The lighting apparatus of claim 15 further comprising a translucent front panel releasably secured relative to said rear panel, said rear panel and said front panel defining a light enclosure.

17. The lighting apparatus of claim 15 wherein said reflective surface is defined by said inner surface of said rear panel.

18. The lighting apparatus of claim 15 further comprising a plurality of resilient clips securingly engaging said flexible tubing.

19. An illuminated backboard comprising:

a frame;

a backboard panel supported by said frame, said backboard panel including a front surface and a rear surface; a rim extending outwardly from adjacent said backboard panel;

a housing including a rear panel having an inner surface and an outer surface, said inner surface of said rear panel positioned with said inner surface facing said rear surface of said backboard panel;

an illumination chamber defined intermediate said rear panel and said backboard panel; and a plurality of light sources supported within said illumination chamber proximate said reflective surface and substantially uniformly distributed within a plane substantially parallel to said backboard panel.

20. The illuminated backboard of claim 19 further comprising a releasable securing device connected to said housing for releasably supporting said rear panel from at least one of said backboard panel and said frame.

21. The illuminated backboard of claim 19 further comprising a reflective surface supported adjacent said plurality of light sources for directing light toward said backboard panel.

22. The illuminated backboard of claim 19 wherein said plurality of lights sources comprise a plurality of lamps and flexible tubing receiving said plurality of lamps.

23. The illuminated backboard of claim 19 further comprising a translucent front panel positioned intermediate said rear panel and said backboard panel, said front panel and said rear panel defining said light chamber.

24. The illuminated backboard of claim 19 further comprising a plurality of fasteners supported by said rear panel and securing said plurality of light sources.

25. The illuminated backboard of claim 19 wherein said rear panel includes a center recessed portion for enhanced structural integrity and light reflectivity.

* * * * *